US010960520B2

(12) United States Patent
Schulz

(10) Patent No.: US 10,960,520 B2
(45) Date of Patent: Mar. 30, 2021

(54) HEX DRIVER

(71) Applicant: Snap-on Incorporated, Kenosha, WI (US)

(72) Inventor: Benjamin T. Schulz, Oak Creek, WI (US)

(73) Assignee: Snap-on Incorporated, Kenosha, WI (US)

( * ) Notice: Subject to any disclaimer, the term of this patent is extended or adjusted under 35 U.S.C. 154(b) by 331 days.

(21) Appl. No.: 16/121,075

(22) Filed: Sep. 4, 2018

(65) Prior Publication Data

US 2020/0070321 A1 Mar. 5, 2020

(51) Int. Cl.
*B25B 15/00* (2006.01)
*B25B 23/00* (2006.01)

(52) U.S. Cl.
CPC ..... *B25B 15/008* (2013.01); *B25B 23/0035* (2013.01)

(58) Field of Classification Search
CPC ... B25B 15/001; B25B 15/004; B25B 15/005; B25B 15/008
See application file for complete search history.

(56) References Cited

U.S. PATENT DOCUMENTS

| | | | |
|---|---|---|---|
| 2,969,250 | A | 1/1961 | Kull |
| 4,338,835 | A | 7/1982 | Simons |
| 4,361,412 | A | 11/1982 | Stolarczyk |
| 4,581,957 | A | 4/1986 | Dossier |
| 5,284,075 | A | 2/1994 | Strauch et al. |
| 5,291,811 | A | 3/1994 | Goss |
| 5,481,948 | A | 1/1996 | Zerkovitz |
| 5,873,290 | A | 2/1999 | Chaconas |
| 6,263,771 | B1 | 7/2001 | Strauch |
| 7,225,710 | B2 | 6/2007 | Pacheco, Jr. |
| 8,454,288 | B2 | 6/2013 | Lin et al. |
| 8,616,097 | B2 | 12/2013 | Hughes et al. |
| 9,302,375 | B2 | 4/2016 | Esper et al. |
| 9,718,170 | B2 | 8/2017 | Eggert et al. |
| 10,697,499 | B2 * | 6/2020 | Goss ..... B25B 15/005 |
| 2006/0266168 | A1 | 11/2006 | Pacheco, Jr. |

FOREIGN PATENT DOCUMENTS

| | | | |
|---|---|---|---|
| CA | 2898480 | A1 | 1/2017 |
| CN | 101208181 | A | 6/2008 |
| CN | 102791432 | A | 11/2012 |
| CN | 103314222 | A | 9/2013 |
| CN | 104889915 | A | 9/2015 |

(Continued)

OTHER PUBLICATIONS

Combined Search and Examination Report for Application No. GB1912264.7 dated Feb. 21, 2020, 8 pages.

(Continued)

*Primary Examiner* — David B. Thomas
(74) *Attorney, Agent, or Firm* — Seyfarth Shaw LLP

(57) ABSTRACT

The present invention relates to tools, for example, hexagonal drivers and bits adapted to engage fasteners. The tool includes an external geometry that is adapted to engage internal walls or flats of a fastener with a larger area compared the prior designs that use a point type of contact. This reduces the stress exerted on the fastener and damage or deformation to the internal walls of the fastener.

19 Claims, 7 Drawing Sheets

(56) References Cited

FOREIGN PATENT DOCUMENTS

| | | | |
|---|---|---|---|
| EP | 442511 | A2 | 8/1991 |
| GB | 1564684 | | 4/1980 |
| JP | S6025661 | A | 2/1985 |
| TW | M386946 | U1 | 8/2010 |
| TW | 201518040 | A | 5/2015 |
| WO | 2016149526 | A1 | 9/2016 |
| WO | 2018150360 | | 8/2018 |

OTHER PUBLICATIONS

Australia Examination Report No. 1 for Application No. 2019213405 dated Jun. 18, 2020, 9 pages.
Stanley Engineering Fastening, TORX Plus Drive System, https://www.stanleyengineeredfastening.com/-media/web/sef/resources/docs/other/torx_plus_brochure.pdf, 16 pages.
Taiwan Office Action for Application No. 108131602 dated Jul. 30, 2020, 7 pages.
Canadian Office Action for Application No. 3052755 dated Oct. 30, 2020, 3 pages.
Chinese Office Action for Application No. 201910829389.3 dated Nov. 17, 2020, 13 pages.
United Kingdom Office Action for Application No. GB1912264.7 dated Jan. 25, 2021, 4 pages.
United Kingdom Combined Search and Examination Report for Application No. GB2013939.0 dated Jan. 28, 2021, 6 pages.

* cited by examiner

HEX DRIVER

TECHNICAL FIELD

The present application relates generally to tools for driving fasteners, and in particular to driving tools, and drivers and sockets for tools.

BACKGROUND

A variety of wrenches and tools are commonly used to apply torque to a work piece, such as a threaded fastener. The work piece may be any number of different sizes and shapes and fitments. Accordingly, many tools include a driver adapted to engage and rotate the different work pieces. For example, for a typical bolt or screw having an internal hex head, exterior walls of a hexagonally shaped driver engage the internal hex walls of the fastener in a point contact, thereby allowing the tool to impart torque to the work piece. However, due to this point contact engagement, the fastener may become pre-maturely fatigued, stripped, and fail due to high stress concentrations being placed on the internal hex walls of the fastener at the points of contact.

SUMMARY

The present invention relates broadly to tools, for example, hexagonal drivers and bits adapted to engage fasteners. In an embodiment, the tool broadly comprises an external geometry adapted to engage internal walls or flats of a fastener with a larger area compared the prior designs that use a point type of contact. This reduces the stresses exerted on the fastener and damage or deformation, e.g. stripping, to the internal walls of the fastener. In an embodiment, the external geometry of the present invention may include a generally hexagonal shape with six (6) corners and six (6) substantially non-linear sidewalls. Each of the sidewalls generally includes first and second non-linear or curved sections interrupted by a linear section. In particular, the sidewalls each has a first corner flat extending to a first curved portion (i.e., radius section) that mergers into an across flat. The across flat extends to a second curved portion (i.e., radius section) that mergers into a second corner flat. When engaged with a fastener, the shape of the external hex driver provides an offset angle of about 0 degrees to about 8 degrees (for a total of about 60 degrees to about 60), and more particularly about 4 degrees (for a total of about 64 degrees) from the flat of the fastener. This allows engagement of a corner flat on the fastener instead of a single point of contact.

In an embodiment, the present invention relates broadly to a tool adapted to engage a recess with a generally hexagonal shape. In an embodiment, the tool broadly comprises a body portion having first and second corners, and a sidewall extending between the first and second corners. The sidewall includes a first substantially straight portion extending from the first corner, a first curved portion extending from the first substantially straight portion, a second curved portion extending from the first curved portion, a substantially straight across flat extending from the second curved portion, a third curved portion extending from the substantially straight across flat, a fourth curved portion extending from the third curved portion, and a second substantially straight portion extending from fourth curved portion to the second corner.

In an embodiment, the present invention broadly relates to a tool adapted to engage a recess with a generally hexagonal shape. In an embodiment, the tool broadly comprises a body portion having first and second corners, and a sidewall extending between the first and second corners. The sidewall includes a first substantially straight portion extending from the first corner, wherein the first substantially straight portion is disposed at an angle of about 64 degrees with respect to a center of the first corner. The sidewall also includes a second substantially straight portion extending from the second corner, wherein the second substantially straight portion is disposed at an angle of about 60 degrees to about 60 degrees, and more particularly, about 64 degrees with respect to a center of the second corner.

In an embodiment, the present invention broadly relates to a tool adapted to engage a recess with a generally hexagonal shape. In an embodiment, the tool broadly comprises a body portion having first and second corners, and a sidewall extending between the first and second corners. The sidewall includes a first substantially straight portion extending from the first corner, a first curved section extending from the first substantially straight portion, and a substantially straight across flat extending from the first curved section towards the second corner. The first curved section may include first and second differing blend radii that blend the first substantially straight portion into the substantially straight across flat.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
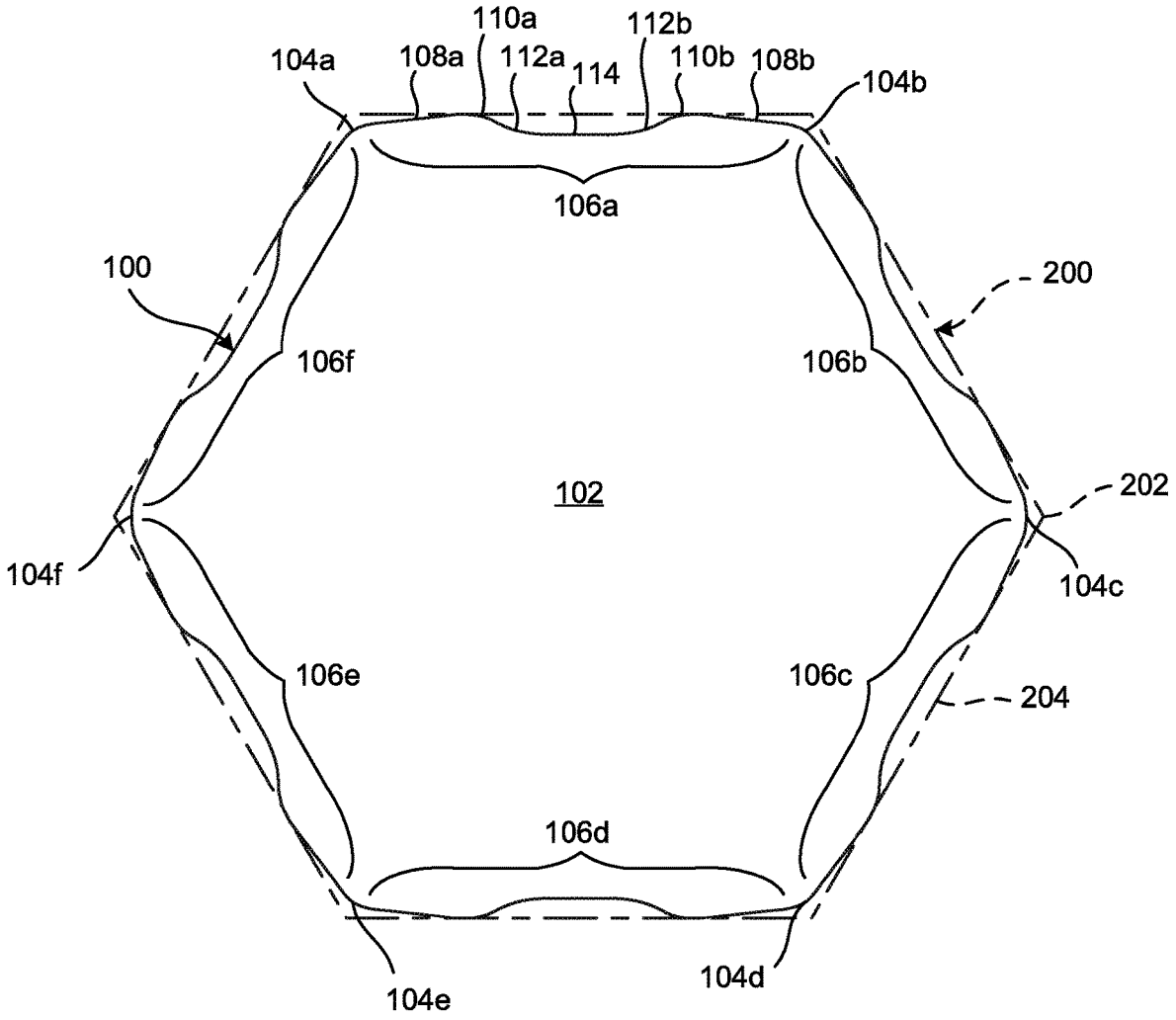
FIG. 1 is a front plan view of an external hex driver, in accordance with an embodiment of the present application, in engagement with a typical internal hexagonal bolt or screw head.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the present invention and is not intended to limit the broad aspect of the invention to any one or more embodiments illustrated herein. As used herein, the term "present invention" is not intended to limit the scope of the claimed invention, but is instead used to discuss exemplary embodiments of the invention for explanatory purposes only.

The present invention broadly relates to tools, for example, hexagonal drivers and bits adapted to engage fasteners. In an embodiment, the tool broadly comprises an external geometry that is adapted to engage internal walls or flats of a fastener with a larger area compared the prior designs that use a point type of contact. This reduces the stress exerted on the fastener and damage or deformation, e.g. stripping, to the internal walls of the fastener.

In an embodiment, the external geometry may include a generally hexagonal shape with six (6) corners and six (6) substantially non-linear sidewalls. Each of the sidewalls generally includes first and second non-linear or curved sections interrupted by a linear section. In particular, the sidewalls have a first corner flat extending to a first curved portion (i.e., radius section) that blends into an across flat. The across flat extends to a second curved portion (i.e., radius section) that blends into a second corner flat. When engaged with a fastener, the shape of the external hex driver provides an offset angle of about 0 degrees to about 8 degrees (for a total of about 60 degrees to about 68 degrees), and more particularly about 4 degrees (for a total of about 64 degrees) from the flat of the fastener. This allows engagement of a corner flat on the fastener instead of a single point of contact.

As illustrated in FIG. 1, the tool 100 has six corners 104*a-f* (which may be referred to as first through sixth corners 104*a-f*) and six substantially non-linear sidewalls 106*a-f* (which may be referred to as first through sixth sidewalls 106*a-f*) respectively extending between the corners 104*a-f*. For example, the first sidewall 106*a* extends between first corner 104*a* and second corner 104*b*; the second sidewall 106*b* extends between second corner 104*b* and third corner 104*c*; the third sidewall 106*c* extends between third corner 104*c* and fourth corner 104*d*; the fourth sidewall 106*d* extends between fourth corner 104*d* and fifth corner 104*e*; the fifth sidewall 106*e* extends between fifth corner 104*e* and sixth corner 104*f*; and the sixth sidewall 106*f* extends between sixth corner 104*f* and first corner 104*a*.

Figure 5:
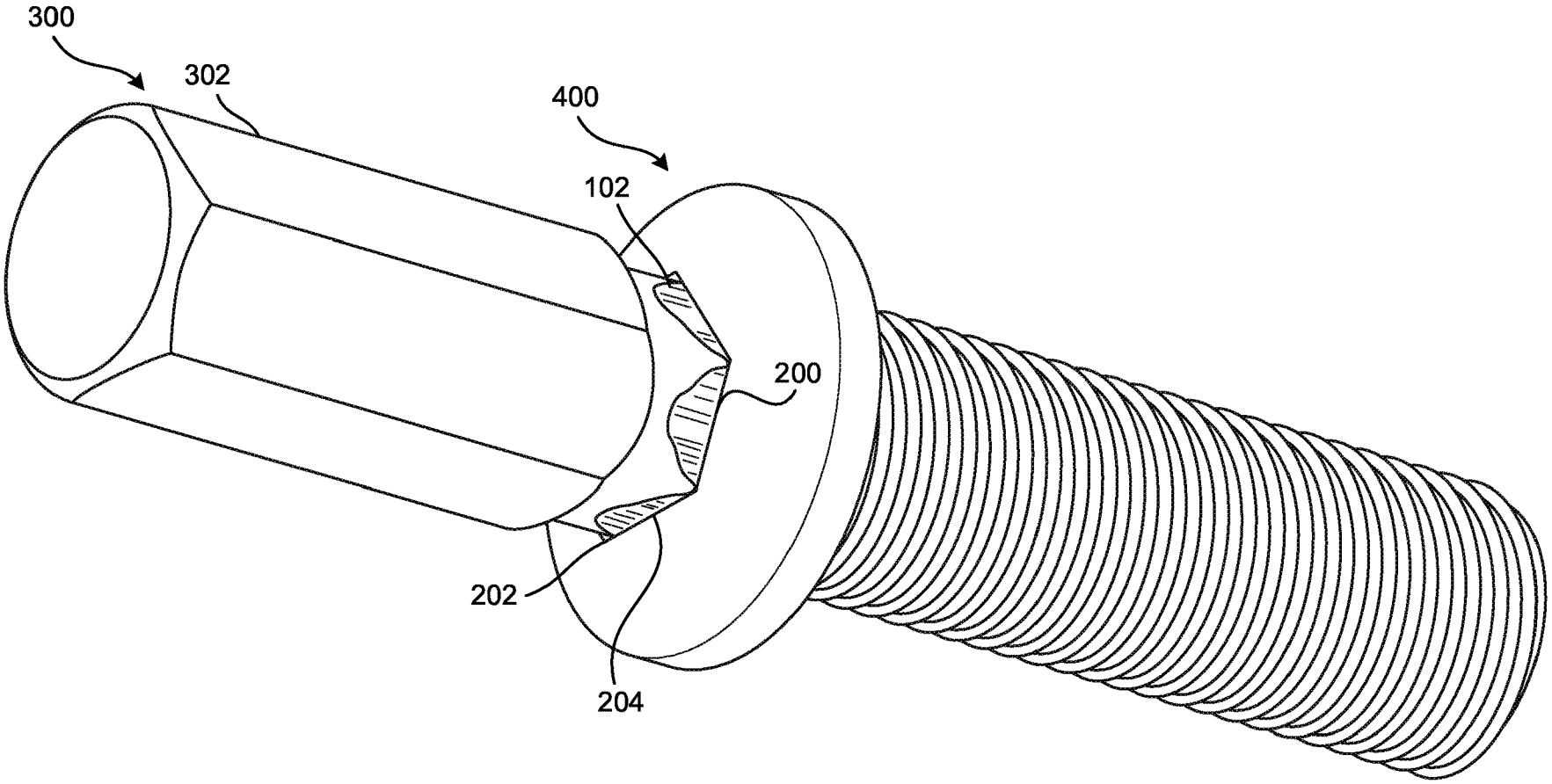
FIG. 5 is a perspective view of the tool bit of FIG. 3 engaged with a fastener.

At least an end portion of the body portion 102 of the tool 100 is adapted to be inserted into and mate with a female hexagonal recess 200 in a fastener (such as fastener 400 illustrated in FIG. 5) that has six corners 202 and six substantially straight sidewalls 204 (also referred to as flanks 204) respectively extending between the corners 202. When inserted into the recess 200, each of the corners 104*a-f* substantially aligns with one of the corners 202. The tool 100, and thereby the body portion 102 may be rotated to apply rotational torque to the fastener. When the tool 100 is rotated, the sidewalls 106*a-f* engage or contact one or more respective sidewalls 202 of the recess 200 of the fastener to apply the torque.

It will be appreciated that each of the first through sixth corners 104*a-f* has the same geometry, and each of the first through sixth sidewalls 106*a-f* has the same geometry. In the interest of brevity, the first sidewall 106*a* is described in detail, with the understanding that the geometry is replicated for each of the other sidewalls 106*a-f*.

As illustrated, the first sidewall 106*a* includes a first substantially straight portion 108*a* (also referred to as a first corner flat 108*a*) that extends between the first corner 104*a* and a first curved portion 110*a* (also referred to as a first radius portion 110*a*). The first curved portion 110*a* extends between the first corner flat 108*a* and a second curved portion 112*a* (also referred to as a second radius portion 112*a*). The second curved portion 112*a* extends between the first curved portion 110*a* and a second substantially straight portion 114 (also referred to as an across flat 114). As illustrated, the first curved portion 110*a* is curved in a first direction, and the second curved portion 112*a* is curved in a second direction substantially opposite the first direction.

The across flat 114 extends from the second curved portion 112*a* towards the second corner 104*b*. As illustrated, the across flat 114 extends between the second curved portion 112*a* and a third curved portion 112*b* (also referred to as a third radius portion 112*b*). The third curved portion 112*b* has a similar curvature as the second curved portion 112*a* and extends between the across flat 114 and a fourth curved portion 110*b* (also referred to as a fourth radius portion 110*b*). The fourth curved portion 110*b* has a similar curvature as the first curved portion 110*a*, and extends between the third curved portion 112*b* and a third substantially straight portion 108*b* (also referred to as a second corner flat 108*b*). The second corner flat 108*b* has a similar geometry as the first corner flat 108*a*, and extends between the fourth curved portion 110*b* and the second corner 104*b*.

As illustrated in FIG. 1, the across flat 114 is recessed with respect to the first and second corner flats 108*a* and 108*b*. This allows for the corner flats 108*a* and 108*b* to have an angle offset of about 4 degrees, as described in further detail below.

The first sidewall 106*a* can also be described as including the first corner flat 108*a* extending from the first corner 104*a*, a first non-linear or curved section (including the first curved portion 110*a* and second curved portion 112*a*), the across flat, a second non-linear or curved section (including the third curved portion 110*b* and fourth curved portion 112*b*), and the second corner flat 108*b* extending from the second corner 104*b*.

It will be appreciated that each half of each of the corners 104*a-f* and of the sidewalls 106*a-f* has a similar geometry. For example, the first corner flat 108*a* and second corner flat 108*b* have a similar geometry; the first curved portion 110*a* and fourth curved portion 110*b* have a similar geometry; and the second curved portion 112*a* and third curved portion 112*b* have a similar geometry. In the interest of brevity, one half of the first corner 104*a* and the first sidewall 106*a* are described in detail, with the understanding that the geometry is replicated for each half of the corners 104*a*-104*f* and sidewalls 106*a-f*.

Figure 2A:
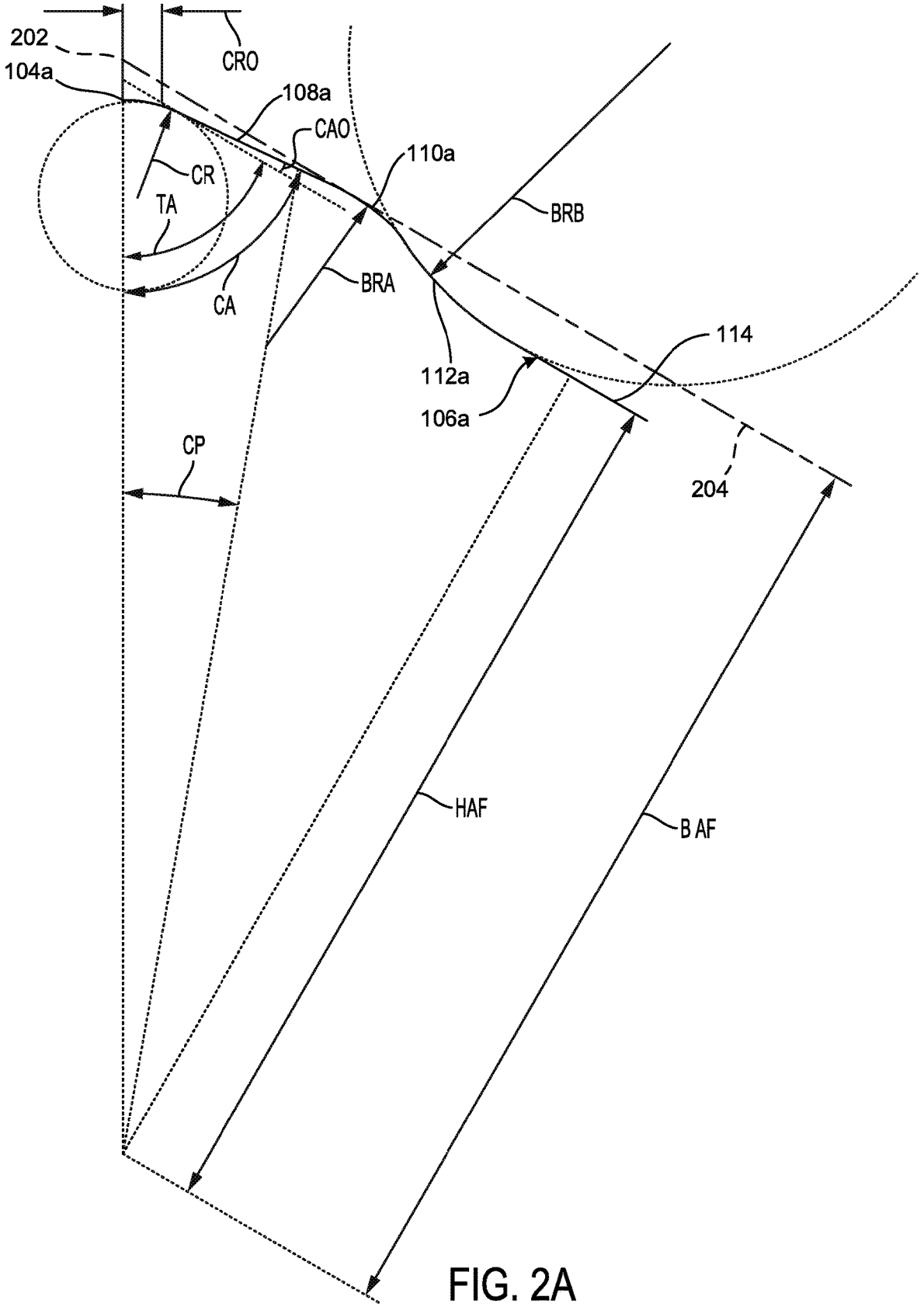
FIG. 2A is an enlarged sectional top plan view of a profile or geometry of half of a sidewall of the driver of FIG. 1, in accordance with an embodiment of the present application.

As illustrated in FIG. 2A, the recess 200 of the fastener has a minimum bolt across flat dimension (BAF), as defined by the American National Standards Institute (ANSI). Using the BAF as a reference, all other dimensions are presented with respect to the BAF. Thus, the dimensions are scalable based on the size of the recess 200. For example, as illustrated, the across flat 114 extends toward the second corner 104*b*, and has a hex across flat (HAF) at the flank center, which is about (0.95) BAF.

Figure 2B:
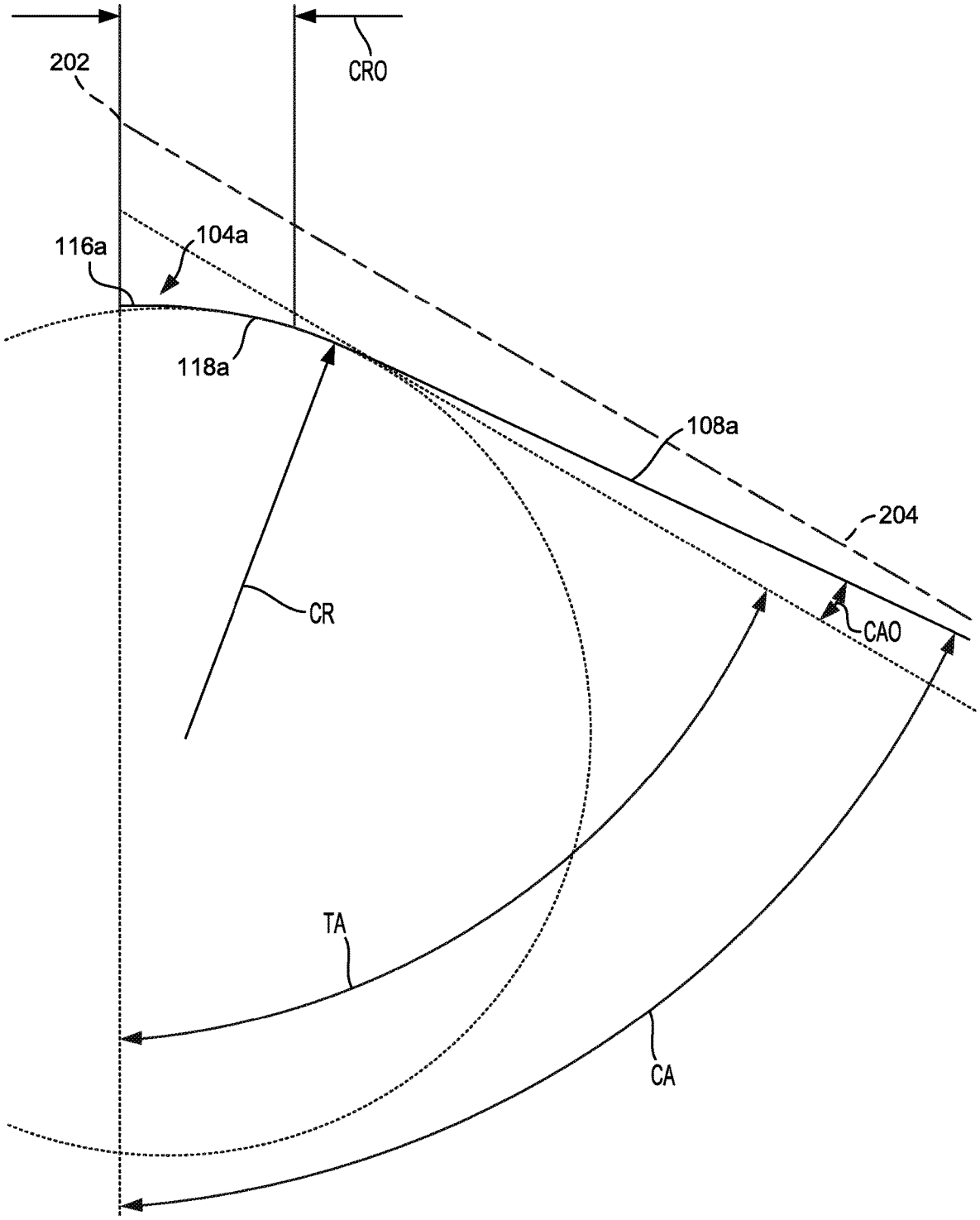
FIG. 2B is an enlarged sectional top plan view of a profile or geometry of a corner of the driver of FIG. 1, in accordance with an embodiment of the present application.
Figure 3:
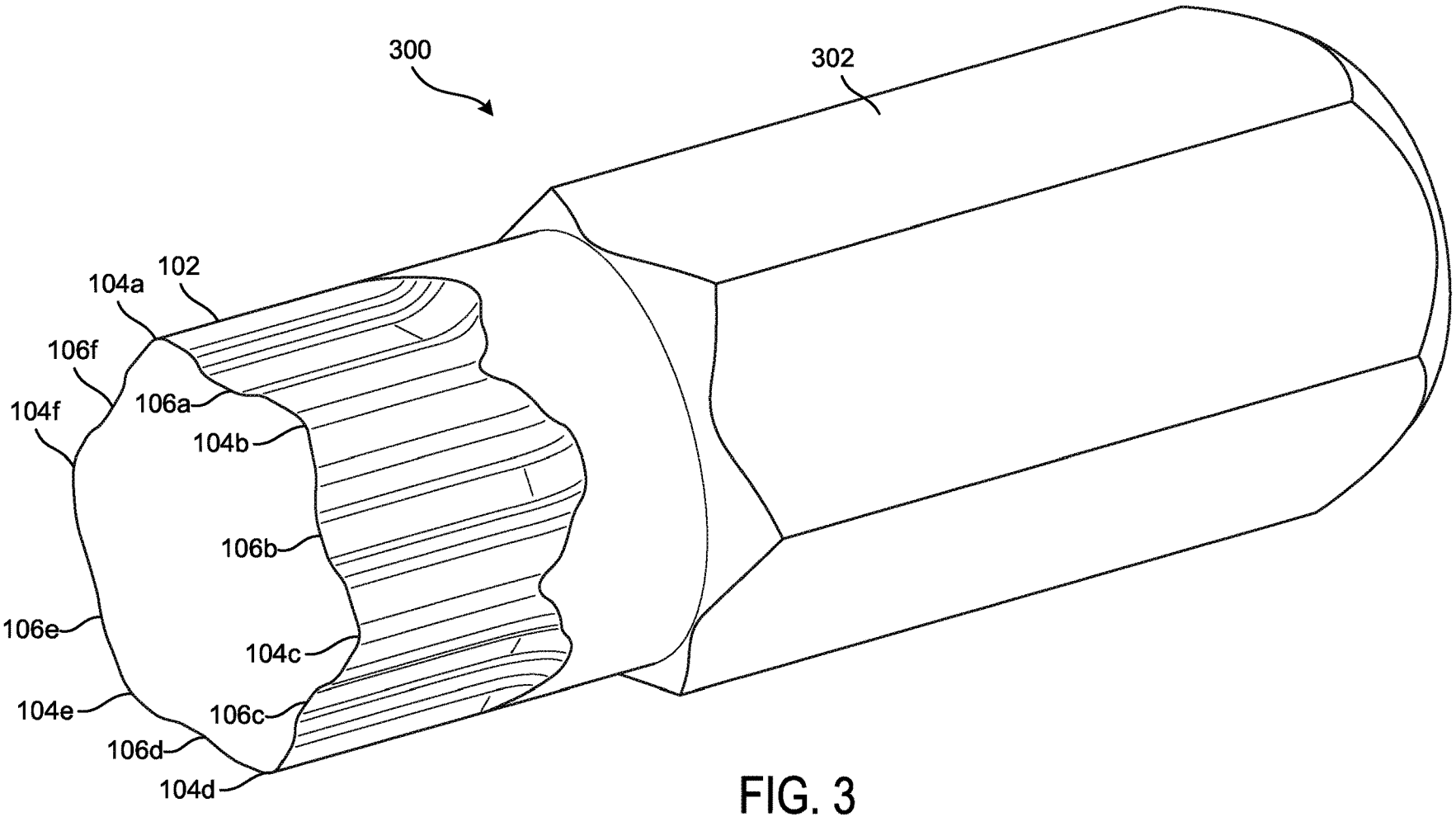
FIG. 3 is a perspective view of a tool bit incorporating the external hex driver, in accordance with an embodiment of the present application.
Figure 4:
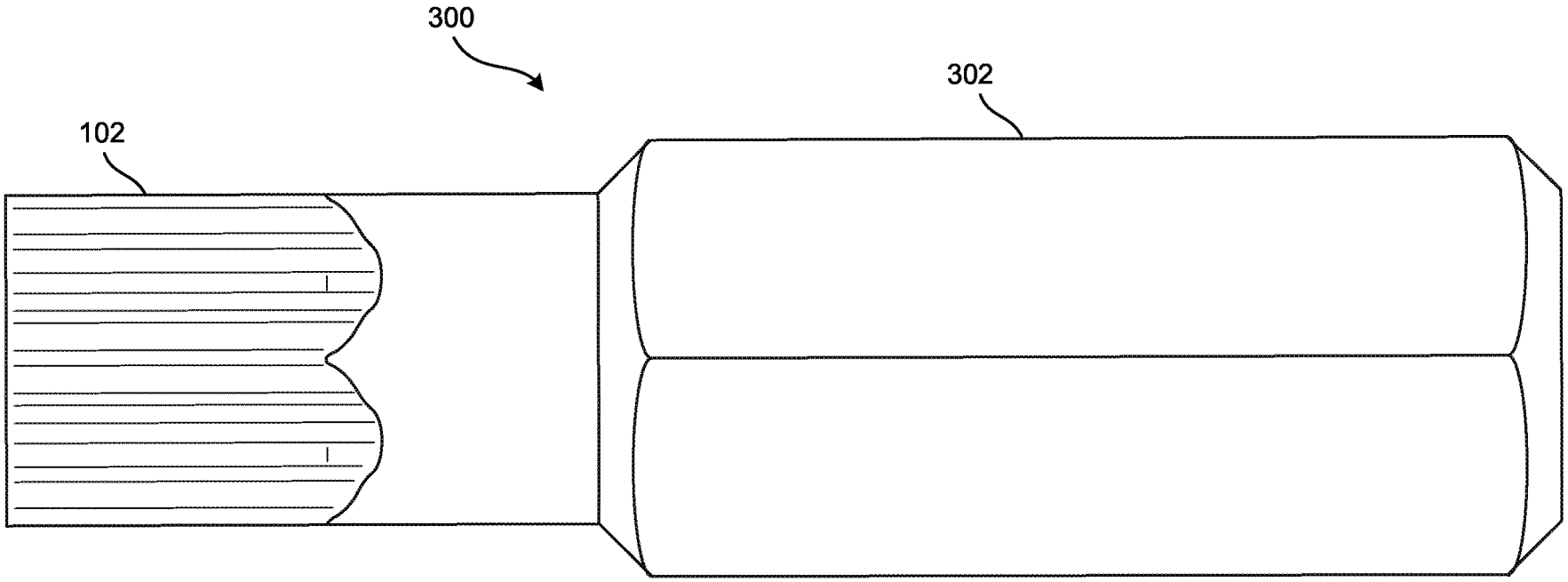
FIG. 4 is a side view of the tool bit of FIG. 3.

Referring to FIGS. 2A and 2B, the first corner 104*a* has a corner radius (CR) at hex across corner. The CR defines the radius of curvature of the corner 104*a* as it blends into the first corner flat 108*a*. As illustrated, the CR is about (0.05) BAF. The first corner 104*a* also has a corner radius offset (CRO) that defines a beginning of the CR. As illustrated, the CRO is about (0.02)BAF.

Referring to FIG. 2B, the half of the first corner 104*a* includes a substantially flat corner portion 116*a* and a curved corner portion 118*a*, The curved corner portion 118*a* has the CR and blends the corner portion 116*a* into the first corner flat 108*a*. It should be appreciated that this geometry is replicated on the other half of the first corner 104*a*, and each of the other corners 104*b*-104*f* has a similar geometry to that of the first corner 104*a*. While, the first corner 104*a* is described as including the corner portions 116*a* and 118*a*, the first corner 104*a* (as well as the other corners 104*b*-1040 may be rounded, flat, pointed, or have any other type of peak or true corner shape that provides for the CR described above. It should also be appreciated that the geometry described with reference to the first corner 104*a* is replicated for each of the other corners 104*b*-104*f*.

Referring to FIGS. 2A and 2B, the first corner flat 108*a* has a corner angle (CA) that defines the pitch of the first corner flat 108*a* with respect to a center of the first corner 104*a*. As illustrated, the CA is 64 degrees. This provides a corner angle offset (CAO) of about 0 degrees to about 8 degrees, about 2 degrees to 8 degrees, and more particularly about 4 degrees. For example, a traditional hexagon includes an angle of 120 degrees between adjacent flats, which defines two half corner traditional angles (TA) of 60 degrees. The CA of the present invention is about 60 degrees to about 68 degrees, 62 degrees to about 68 degrees, and more particularly about 64 degrees, providing an offset (CAO) of about 0 degrees to about 8 degrees, 2 degrees to about 8 degrees, and more particularly about 4 degrees with respect to a traditional hexagon. Accordingly, an angle defined between adjacent corner flats (such as corner flats connected by the first corner 104*a*) is about 120 degrees to about 136 degrees, about 124 degrees to about 136 degrees, and more particularly about 128 degrees.

Referring to FIG. 2A, the first curved portion 110*a* has a first blend radius (BRA) that defines the radius of curvature of the first curved portion 110*a* as it blends the first corner flat 108*a* into the second curved portion 112*a*. For example, the BRA is the radius of curvature from the flat at flank center to point of contact. As illustrated, a center point (CP) having an angle of about 10 degrees defines a center point of the BRA, and the BRA is about (0.10)BAF.

The second curved portion 112*a* has a second blend radius (BRB) that defines the radius of curvature of the second curved portion 112*a* as it blends the first curved portion 110*a* into the across flat 114. For example, the BRB is the radius of curvature from the flat at flank center to BRA. As illustrated, the BRB is about (0.20)BAF. Accordingly, the BRB is different than the BRA, and the BRB is greater than the BRA. Described another way, the BRA and BRB are different from one another, and the BRA is smaller or less than the BRB.

Further, the half of the sidewall 106*a* has three radii. The first radius corresponds to the CR of the first corner 104*a*. The second radius corresponds the to the BRA of the first curved portion 110*a*. Similarly, the third radius corresponds to the BRB of the second curved portion 112*a*.

As described above, each half of each of the corners 104*a-f* and of the sidewalls 106*a-f* has a similar geometry. Accordingly, each geometry can be described as follows: HAF—about (0.95)BAF, BRA—about (0.10)BAF, BRB—about (0.20)BAF, CR—about (0.05)BAF, CRO—about (0.02)BAF, CA—about 60 degrees to about 68 (more particularly, about 62 degrees to about 68 degrees, and more particularly, about 64 degrees), CAO—about 0 degrees to about 8 degrees (more particularly about 2 degrees to about 8 degrees, and more particularly about 4 degrees), and CP—about 10 degrees.

In some embodiments, the tool 100 may be a tool, such as a screwdriver, hex key (such as an "L" shaped hex key), a bit socket adapted to be coupled to another tool, etc. It should be appreciated that a portion of or the entire shaft of the screwdriver, a portion of or the entire hex key, and/or a portion of or the entire bit may have the geometry described above. In other embodiments, the tool 100 may be a bit or bit socket adapted to be coupled to a mating recess or lug of another tool, such as a screwdriver, socket, socket or ratchet wrench, drill, impact gun, torque wrench, box wrench, etc.

An example of a bit 300 incorporating the external geometry described above is illustrated and described with reference to FIGS. 3-6. The bit 300 includes the body portion 102 with the six corners 104*a-f* and six substantially non-linear sidewalls 106*a-f* respectively extending between the corners 104*a-f*, as described above. As described above, and referring to FIG. 5, the body portion 102 is adapted to be inserted into and mate with a female hexagonal recess 200 in a fastener 400 that has six corners 202 and six substantially straight sidewalls 204 (also referred to as flanks 204) respectively extending between the corners 202. When inserted into the recess 200, each of the corners 104*a-f* substantially aligns with one of the corners 202. The bit 300, and thereby the body portion 102 may be rotated to apply rotational torque to the fastener 400. When the bit 300 is rotated, the sidewalls 106*a-f* engage or contact one or more respective sidewalls 202 of the recess 200 of the fastener 400 to apply the torque.

Figure 6:
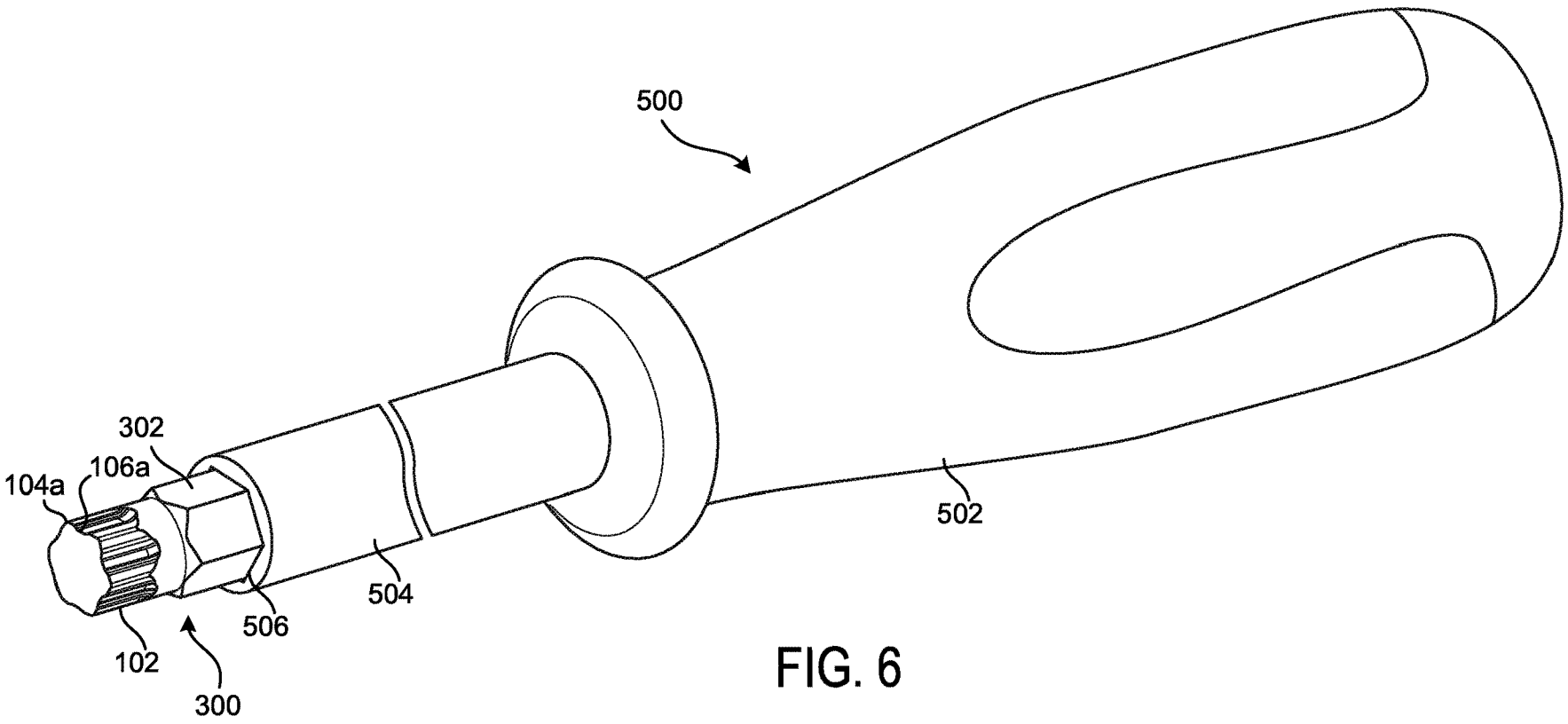
FIG. 6 is a perspective view of the tool bit of FIG. 3 coupled to a tool.

The tool 300 also includes a tool engagement portion 302 adapted to be inserted into and engage a corresponding recess of another tool, such as a screwdriver, socket, socket wrench, power tool, etc. The tool engagement portion 302 extends from a first end of the tool 300 and transitions into the body portion 102. Referring to FIG. 6, in an example, the tool engagement portion 302 may be inserted into or engaged with a recess 506 of a driver tool 500. As illustrated, the driver tool 500 may include a handle 502, a shaft 504 extending from the handle 502, and the recess 506 extending into an end of the shaft 504 opposite the handle 502. When the tool engagement portion 302 is engaged with the recess 506, the handle 502 may be rotated to rotate the tool bit 300, to thereby apply torque to a fastener or other object engaged with the body portion 102 of the tool bit 300.

As illustrated, the tool engagement portion 302 has a hexagonal shape. However, the tool engagement portion 302 may have other shapes, such as generally square, rectangular, triangular, circular, and other shapes that are adapted to engage a corresponding recess of another tool, fastener, or device, etc.

The tool 300 may also have ends that are chamfered to allow for easier insertion of the end of the body portion 102 into a hexagonal recess, and easier insertion of the end of the tool engagement portion 302 into a corresponding recess of another tool, fastener, or device, etc.

Further, the geometry of the exterior surface of the tools (body portion 102) described herein may be applied to other types of tools for applying torque to fasteners. For example, a socket, a wrench or box wrench may include internal geometries corresponding to the external geometries disclosed herein to allow the wrench or box wrench to engage a fastener with an external hexagonal geometry. Similarly, other tools and/or fasteners may include the geometries disclosed herein.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art. Moreover, unless specifically stated any use of the terms first, second, etc. do not denote any order or importance, but rather the terms first, second, etc. are merely used to distinguish one element from another.

What is claimed is:

1. A tool adapted to engage a recess with a generally hexagonal shape, comprising:

a body portion having first and second corners, and a sidewall extending between the first and second corners, wherein the sidewall includes:

a first substantially straight portion extending from the first corner, wherein the first substantially straight portion is disposed at an angle of about 62 degrees to about 68 degrees with respect to a center of the first corner;

a first curved portion extending from the first substantially straight portion;

a second curved portion extending from the first curved portion;

a second substantially straight portion extending from the second corner, wherein the second substantially straight portion is disposed at an angle of about 62 degrees to about 68 degrees with respect to a center of the second corner; and a substantially straight across flat disposed between the second curved portion and second substantially straight portion.

2. The tool of claim 1, wherein the substantially straight across flat is recessed with respect to the first and second substantially straight portions.

3. The tool of claim 1, wherein the second curved portion extends between the first curved portion and the substantially straight across flat.

4. The tool of claim 1, wherein the first curved portion is curved in a first direction, and the second curved portion is curved in a second direction substantially opposite the first direction.

5. The tool of claim 4, wherein the first curved portion has a first blend radius, and the second curved portion has a second blend radius different that the first blend radius.

6. The tool of claim 5, wherein the first blend radius is less than the second blend radius.

7. The tool of claim 1, wherein the first substantially straight portion is disposed at an angle of about 64 degrees with respect to the center of the first corner, and the second substantially straight portion is disposed at an angle of about 64 degrees with respect to the center of the second corner.

8. A tool adapted to engage a recess having a generally hexagonal shape, comprising:

a body portion having first and second corners, and a sidewall extending between the first and second corners, wherein the sidewall includes:

a first substantially straight portion extending from the first corner;

a first curved portion extending from the first substantially straight portion;

a second curved portion extending from the first curved portion;

a substantially straight across flat extending from the second curved portion;

a third curved portion extending from the substantially straight across flat;

a fourth curved portion extending from the third curved portion; and a second substantially straight portion extending from fourth curved portion to the second corner.

9. The tool of claim 8, wherein the first and fourth curved portions have a first blend radius.

10. The tool of claim 9, wherein the second and third curved portions have a second blend radius different that the first blend radius.

11. The tool of claim 10, wherein the first blend radius is less than the second blend radius.

12. The tool of claim 8, wherein the substantially straight across flat is recessed with respect to the first and second substantially straight portions.

13. The tool of claim 8, wherein the first substantially straight portion is disposed at an angle of about 62 degrees to about 68 degrees with respect to a center of the first corner, and the second substantially straight portion is disposed at an angle of about 62 degrees to about 68 degrees with respect to a center of the second corner.

14. The tool of claim 13, wherein the first substantially straight portion is disposed at an angle of about 64 degrees with respect to a center of the first corner, and the second substantially straight portion is disposed at an angle of about 64 degrees with respect to a center of the second corner.

15. The tool of claim 8, wherein the first curved portion is curved in a first direction, and the second curved portion is curved in a second direction substantially opposite the first direction.

16. A tool adapted to engage a recess with a generally hexagonal shape, comprising:

a body portion having first and second corners, and a sidewall extending between the first and second corners, wherein the sidewall includes:

a first substantially straight portion extending from the first corner;

a first curved section extending from the first substantially straight portion; and a substantially straight across flat extending from the first curved section towards the second corner, wherein the first curved section includes first and second differing blend radii that blend the first substantially straight portion into the substantially straight across flat.

17. The tool of claim 16, wherein the first curved section includes a first curved portion that is curved in a first direction, and a second curved portion that is curved in a second direction substantially opposite the first direction.

18. The tool of claim 16, wherein the first substantially straight portion is disposed at an angle of about 62 degrees to about 68 degrees with respect to a center of the first corner.

19. The tool of claim 18, wherein the first substantially straight portion is disposed at an angle of about 64 degrees with respect to the center of the first corner.

* * * * *